United States Patent [19]

Yamagishi et al.

[11] Patent Number: 4,968,074

[45] Date of Patent: Nov. 6, 1990

[54] AUTOMATIC DOOR LATCHING SYSTEM

[75] Inventors: Jun Yamagishi; Kouichi Shiota; Masaharu Matsumoto, all of Yokohama, Japan

[73] Assignee: Ohi Seisakusho Co., Ltd., Yokohama, Japan

[21] Appl. No.: 287,277

[22] Filed: Dec. 21, 1988

[30] Foreign Application Priority Data

Dec. 22, 1987 [JP] Japan ..... 62-193515[U]
Jan. 21, 1988 [JP] Japan ..... 63-9527
Sep. 3, 1988 [JP] Japan ..... 63-219632

[51] Int. Cl.[5] ..... E05C 13/10

[52] U.S. Cl. ..... 292/201; 292/216; 292/DIG. 23

[58] Field of Search ..... 292/144, 201, 216, 280, 292/336.3, DIG. 23

[56] References Cited

U.S. PATENT DOCUMENTS

| | | | |
|---|---|---|---|
| 3,572,065 | 3/1971 | Peters | 292/201 X |
| 3,572,066 | 3/1971 | Peters | 292/201 X |
| 3,989,287 | 11/1976 | Sheesley | 292/201 |
| 4,468,941 | 9/1984 | Bascou | 292/201 X |
| 4,569,544 | 2/1986 | Escaravage | 292/201 X |
| 4,762,348 | 8/1988 | Matsumoto | 292/201 |
| 4,763,936 | 8/1988 | Rogakos et al. | 292/201 |
| 4,815,775 | 3/1989 | Mertin et al. | 292/201 |

FOREIGN PATENT DOCUMENTS

| | | |
|---|---|---|
| 0098560 | 1/1984 | European Pat. Off. . |
| 58-191884 | 11/1983 | Japan . |
| 60-137067 | 9/1985 | Japan . |
| 61-87416 | 6/1986 | Japan . |

*Primary Examiner*—Eric K. Nicholson
*Attorney, Agent, or Firm*—Foley & Lardner, Schwartz, Jeffery, Schwaab, Mack, Blumenthal & Evans

[57] ABSTRACT

Herein disclosed is an automatic door latching system for a motor vehicle having a vehicle body and a door. The automatic door latching system comprises a door lock device carried by the door to move therewith, the lock device having a latch plate which is pivotal to assume a full-open position wherein the latch plate releases a striker secured to the vehicle body, a half-latch position wherein the latch plate is halfly engaged with the striker and a full-latch position wherein the latch plate is fully engaged with the striker; a driver lever integrally connected to the latch plate to move therewith; a closing lever which is pivotal to assume a rest position and an operative position, the closing lever pushing the driven lever in a direction to cause the latch plate to pivot from the half-latch position to the full-latch position when pivoting from the rest position toward the operative position; an electric drive means mounted to the door to drive the closing lever when energized; a half-latch detecting means for detecting the half-latch condition of the latch plate; a full-latch detecting means for detecting the full-latch condition of the latch plate; a rest position detecting means for detecting the closing lever being at the rest position; and a first control unit mounted to the door for controlling operation of said drive means in accordance with information signals issued by said half-latch, full-latch and rest position detecting means.

20 Claims, 12 Drawing Sheets

AUTOMATIC DOOR LATCHING SYSTEM

BACKGROUND OF THE INVENTION

1. Field of the Invention

The present invention relates in general to an automatic door closing system and more particularly to an automatic door latching system for a motor vehicle, which, upon sensing a half-latched condition of the door, automatically makes the door fully latched.

2. Description of the Prior Art

In order to clarify the task of the present invention, one of conventional automatic door latching systems will be described prior to describing in detail the present invention, which is disclosed in Japanese Utility Model First Provisional Publication No. 60-137067.

In the device of the publication, there is used a closing lever for achieving the full-latched condition of the door from the half-latched condition of the same. That is, the closing lever is driven to turn by an electric motor via a worm and a worm wheel. During the turning of the closing lever, the same is brought into abutment with a latch plate (more specifically, an extension of the latch plate) of a door lock device and enforcedly moves the latch plate from a half-latch position to a full-latch position. The closing lever makes one turn in the same direction every time the full-latching of the lock device is carried out. That is, when the closing lever is turned to a rest position, a subsequent turning of the lever starts from the rest position.

However, the conventional device of the publication has the following drawbacks due to its inherent construction.

First, the rest position (or start position) of the closing lever tends to change even slightly each time the lever is turned. This change tends to mistime a subsequent operation of the automatic door latching system.

Second, because the closing lever is turned through about 360 degrees extending beyond a degree which is really needed for moving the latch plate from the half-latch position to the full-latch position, the rotation of the closing lever is very wasteful of space. This induces a bulky construction of the latch device and thus that of the automatic door latching system.

SUMMARY OF THE INVENTION

It is therefore an object of the present invention to provide an automatic door latching system which is free of the above-mentioned drawbacks.

According to a first aspect of the present invention, there is provided an automatic door latching system in which a closing lever is employed for enforcedly turning a latch plate of a door lock device from the half-latch position to the full-latch position, and in which the closing lever is enforcedly returned to its proper rest position after achieving the turning of the latch plate to the full-latch position.

According to a second aspect of the present invention, there is provided an automatic door latching system in which the closing lever is pivoted by only a small angle for achieving the pivoting of the latch plate to the full-latch position.

According to a third aspect of the present invention, there is provided an automatic door latching system in which a timer is arranged in order that when the full-latching of the door is accomplished, electric power supply to electric devices of the system is ceased.

According to a fourth aspect of the present invention, there is provided an automatic door latching system in which a door sensing switch is employed for breaking a circuit between a battery and a body-mounted connector (viz., electric outlet) when the door is opened.

According to a fifth aspect of the present invention, there is provided an automatic door latching system in which a safety switch is employed for preventing the latch plate from assuming the full-latch position when a foreign thing is accidently put between a front edge of the door and a front end wall of a door opening of the vehicle body.

According to a sixth embodiment of the present invention, there is provided an automatic door latching system in which a timer is employed for enforcedly returning the closing lever to its rest position when the full-latch condition of the latch plate is not provided within a given time from the time when a half-latched condition of the door is detected.

According to the present invention, there is provided, in a motor vehicle having a vehicle body and a door, an automatic door latching system which comprises a door lock device carried by the door to move therewith, the lock device having a latch plate which is pivotal to assume a full-open position wherein the latch plate releases a striker secured to the vehicle body, a half-latch position wherein the latch plate is halfly engaged with the striker and a full-latch position wherein the latch plate is fully engaged with the striker; a driven lever integrally connected to the latch plate to move therewith; a closing lever which is pivotal between a rest position and an operative position, the closing lever pushing the driven lever in a direction to cause the latch plate to pivot from the half-latch position to the full-latch position when pivoting from the rest position to the operative position; an electric drive means mounted to the door to drive the closing lever when energized; a half-latch detecting means for detecting the half-latch condition of the latch plate; a full-latch detecting means for detecting the full-latch condition of the latch plate; a rest position detecting means for detecting the closing lever being at the rest position; and a first control unit mounted to the door for controlling operation of the drive means in accordance with information signals issued by the half-latch, full-latch and rest position detecting means.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an automatic door latching system according to the present invention will be described in detail with reference to the accompanying drawings.

Referring to FIGS. 1 to 9, there is shown a first embodiment of the present invention.

Figure 1:
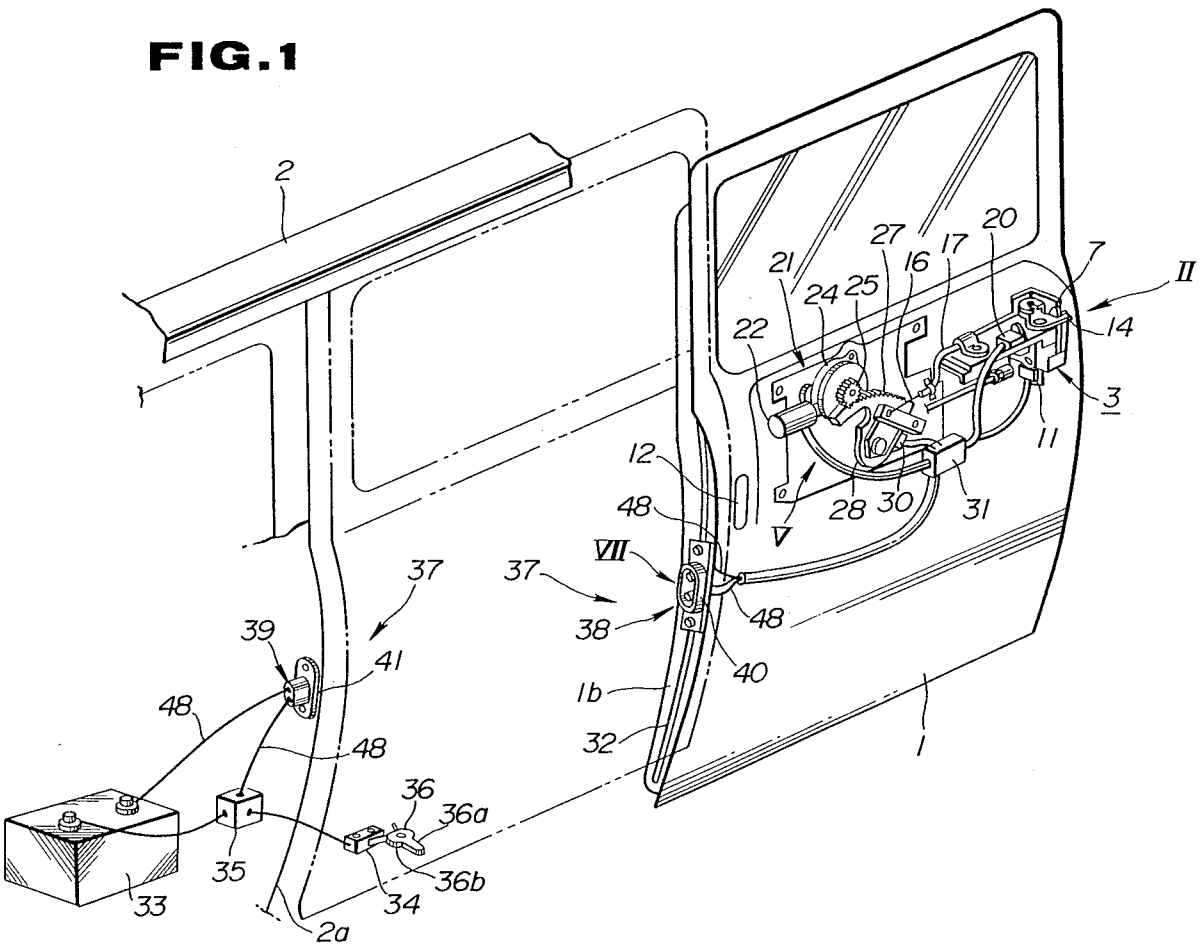
FIG. 1 is a partially cut side view of a motor vehicle, showing a slide door to which a first embodiment of the present invention is practically applied.

In FIG. 1, denoted by numeral 1 is a slide door of a motor vehicle, which is slidably moved along a side wall of a vehicle body 2 between a full-open position as illustrated by a solid line and a full-closed position as illustrated by a phantom line. For this sliding movement, a known slide mechanism is employed, which includes for example a guide rail (not shown) fixed to the vehicle body 2 and rollers (not shown) held by the door 1 and guided by the guide rail. The guide rail is curved so that at an initial stage of the door opening operation, the door 1 is moved outward somewhat from the full-closed position and thereafter the same is moved rearward in parallel with the side wall of the vehicle body 2 to the full-open position.

Figure 2:
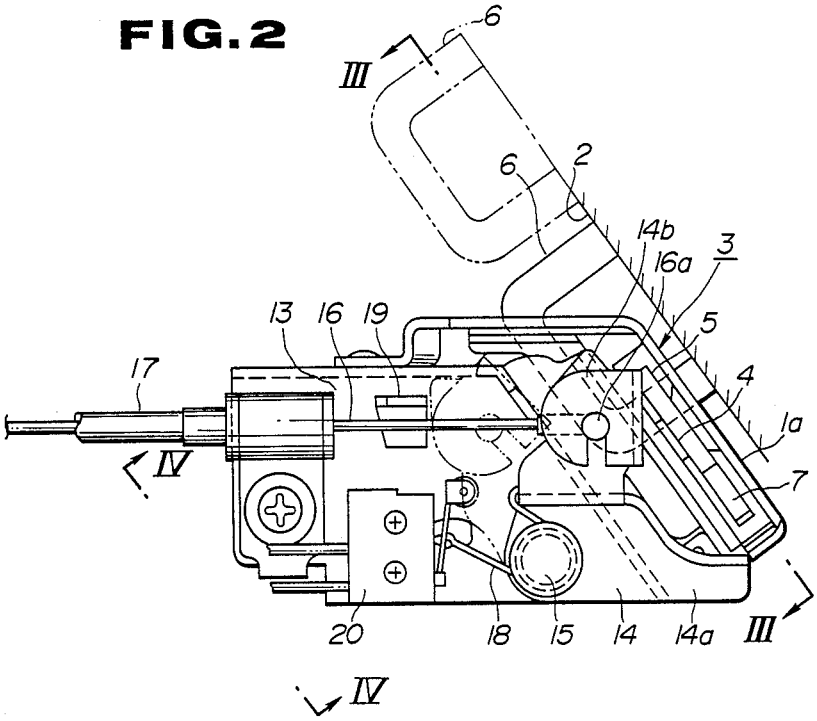
FIG. 2 is a horizontally sectional view of an essential part of the automatic door latching system, which is the sectional view of the part indicated by the arrow II of FIG. 1.

As is seen from FIGS. 1 and 2, the door 1 has a rear end surface 1*a* inclined toward the front of the door 1, which surface is parallel with a travelling path described by the door 1 when the door 1 is at the initial stage of the opening operation. To the rear end portion of the door 1, there is mounted a door lock device 3 which will be described in the following.

Figure 3:
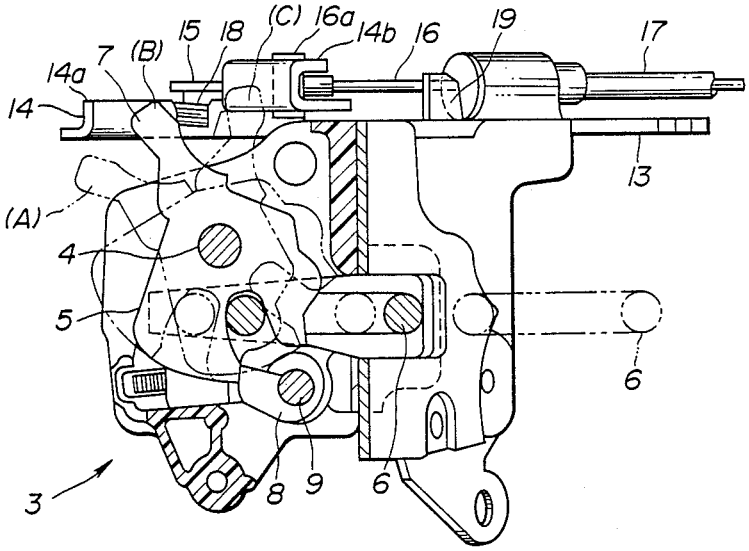
FIG. 3 is a sectional view taken along the line III—III of FIG. 2.

The door lock device 3 comprises a latch plate 5 which is pivotally installed in the door 1 through a shaft 4 which is perpendicular to the inclined rear end surface 1*a*. The latch plate 5 is so shaped and arranged as to be latchingly engageable with a striker 6 (see FIGS. 2 and 3) which is secured to a rear end wall of a door opening of the vehicle body 2. That is, as is shown in FIG. 3, in response to opening and closing movement of the door 1, the latch plate 5 is pivotal to assume an open-position A wherein the latch plate 5 releases the striker 6, a half-latch position B wherein the latch plate 5 halfly or incompletely latches the striker 6 and a full-latch position C wherein the latch plates fully latches the striker 6. When the latch plate 5 assumes the full-latch position C, the door 1 is fully closed and latched with respect to the door opening of the vehicle body 2.

As is seen from FIG. 3, the latch plate 5 is integrally formed with a driven lever 7 which extends upward.

Denoted by numeral 8 is a pawl (see FIG. 3) which is engageable with the latch plate 5. The pawl 8 is integrally formed on a shaft 9 which extends in parallel with the above-mentioned shaft 4 of the latch plate 5. When the pawl 8 assumes the illustrated operative position in FIG. 3, a counterclockwise rotation of the latch plate 5 from the half-latch position B or full-latch position C is interrupted by the pawl 8. While, when the pawl 8 is pivoted counterclockwise together with the shaft 9 to its inoperative position (not shown), the latch plate 5 becomes free. More specifically, when assuming the inoperative position, the pawl 8 is put on a peripheral edge of the latch plate 5. That is, the pawl 8 assumes the illustrated operative position only when the latch plate 5 assumes either the half-latch position B or the full-latch position C.

Figure 4:
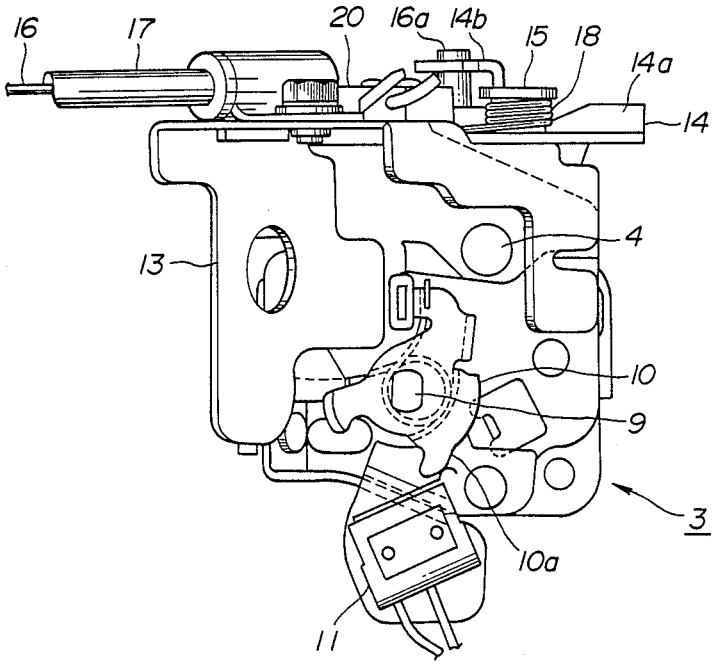
FIG. 4 is a view taken from the direction of the arrows IV—IV of FIG. 2.

As is seen from FIG. 4, a generally triangular open lever 10 is fixed to a leading end of the shaft 9 of the pawl 8 to move therewith. When the latch plate 5 comes to the operative position, a projection 10*a* of the open lever 10 is brought into contact with a detecting pin (no numeral) of a half-latch detecting switch 11. Thus, the operative position of the pawl 8 is detected by the switch 11.

In the described embodiment, the switch 11 is so constructed as to issue a signal representing the pawl 8 being at the operative position when the pawl 8 comes to the operative position first during the closing movement of the door 1. In other words, the switch 11 can detect that the latch plate 5 has assumed the half-latch position B. In fact, as will become apparent as the description proceeds, during the movement of the door 1 to its fully-closed position, the pawl 8 is subjected to pivot two times due to pivoting movement of the latch plate 5 thereby assuming the operative position two times. That is, the first pivoting of the pawl 8 occurs when the latch plate 5 is brought to the half-latch position B, and the second pivoting occurs when the latch plate 5 is brought to the full-latch position C. This will be understood from the illustration of FIG. 3.

Thus, the switch 11 can be constructed to detect the latch plate 5 being at the full-latch position C. Thus, in this case, an after-mentioned full-latch detecting switch 20 may be omitted.

The basic function of the open lever 10 is to cancel an engaged condition of the door lock device 3 in response to operation of door latch control devices, such as an outer door handle 12 (see FIG. 1), an inner door handle and the like. The function of the open lever 10 will be understood from, for example, the description of U.S. Pat. No. 4,762,348 issued Aug. 9, 1988.

As is seen from FIGS. 2 and 3, above the door lock device 3, there is arranged a horizontally extending supporting plate 13 on which a generally L-shaped closing lever 14 is pivotally disposed through a shaft 15. As is seen from FIG. 2, the closing lever 14 has the shaft 15 at a junction portion of two arm portions 14*a* and 14*b* thereof.

As is seen from FIG. 2, the closing lever 14 is pivotal between its rest position as illustrated by a solid line wherein the arm portion 14*a* is remote from a travelling path described by the driven lever 7 of the latch plate 5 and its operative position as illustrated by a phantom line wherein the arm portion 14*a* pushes the driven lever 7 to such a position as to cause the latch plate 5 to assume the full-latch position C. More specifically, during a counterclockwise pivoting of the closing lever 14 in FIG. 2, the arm portion 14*a* is brought into contact with the driven lever 7 and brings the same to such position causing the latch plate 5 to swing from the half-latch position B to the full-latch position C.

To the other arm portion 14*b* of the closing lever 14, there is pivotally and detachably connected a cylindrical end member 16*a* which is fixed to an end of a wire 16. When the wire 16 is pulled leftward in FIG. 2 by an after-mentioned drive means 21, the closing lever 14 carries out the above-mentioned counterclockwise pivoting.

Denoted by numeral 17 is a guide tube through which the wire 16 extends to the drive means 21. Denoted by 18 is a spring for biasing the closing lever 14 toward the rest position. Denoted by 19 is a stopper for the closing lever 14, against which the arm portion 14*b* abuts when the lever 14 comes to the operative position.

A full-latch detecting switch 20 is mounted to the supporting plate 13, which detects the latch plate 5 being at the full-latch position. That is, when the closing lever 14 comes to the operative position, the arm portion 14*b* is brought into contact with a detecting pin (no numeral) of the switch 20.

In practice, the closing lever 14 reaches the operative position when the latch plate 5 is pivoted somewhat beyond the full-latch position C. Thus, the switch 20 issues a signal representing the latch plate 5 being at the full-latch position C when the latch plate 5 is pivoted beyond the full-latch position C.

Figure 5A:
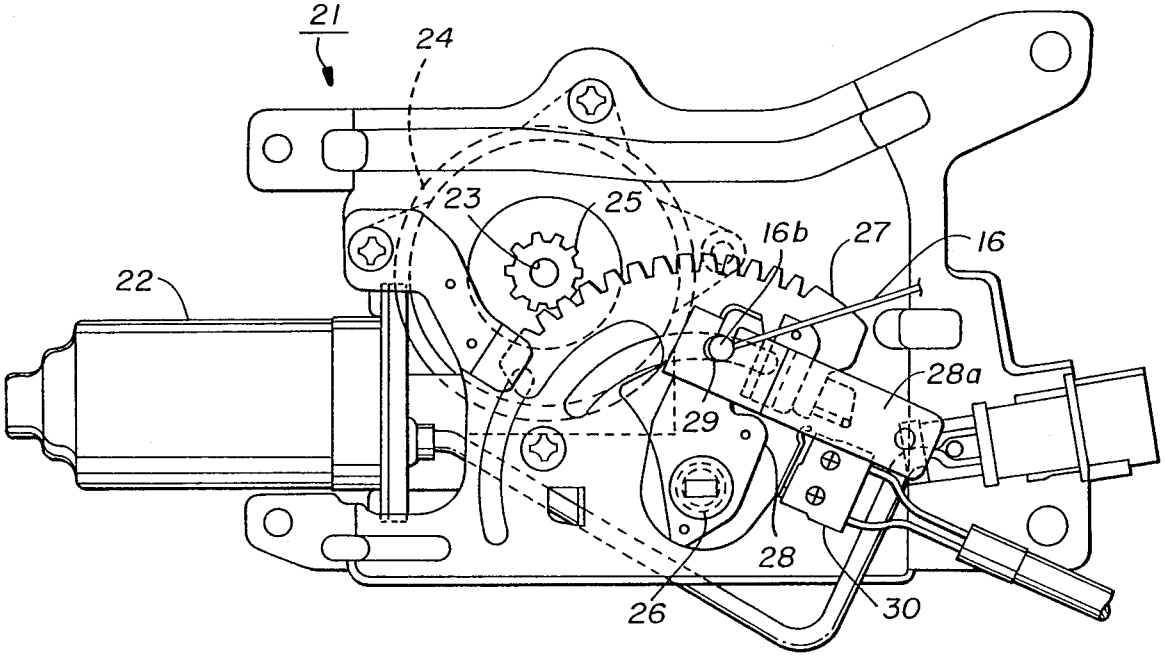
FIG. 5*a* is an enlarged side view of a stationary position of drive mechanism employed in the system of the first embodiment, the drive mechanism being indicated by the arrow V in FIG. 1.
Figure 5B:
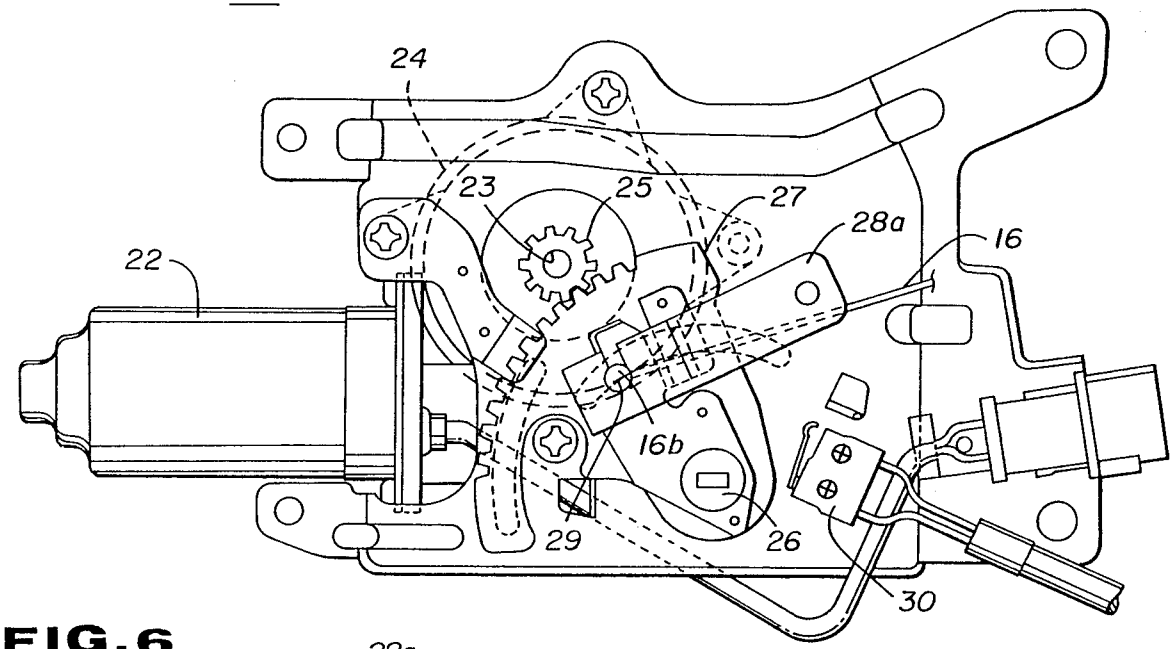
FIG. 5*b* is an enlarged side view of a moved position of a drive mechanism employed in the system of the first embodiment.

FIG. 5 shows the drive means 21 which is located at a generally middle portion of the door 1 as will be seen from FIG. 1.

The drive means 21 comprises a reversible electric motor 22. An output of the motor 22 is fed to a speed reduction device 24 to drive its output shaft 23 at a reduced speed. A pinion 25 is disposed on the output shaft 23 and operatively engaged with a sector gear 27. The sector gear 27 is pivotally connected to the door 1 through a shaft 26 which is parallel with the output shaft 23. The sector gear 27 has at its rim a plurality of teeth 27*a* engaged with the pinion 25. A rotating lever 28 is pivotally disposed about the shaft 26 of the sector gear 27. The rotating lever 28 has a leading end portion (see FIG. 6) to which the other end of the wire 16 is pivotally connected through a cylindrical end member 16*b*. It is to be noted that the rotating lever 28 is spot-welded to the sector gear 27 to move together about the shaft 26.

Figure 6:
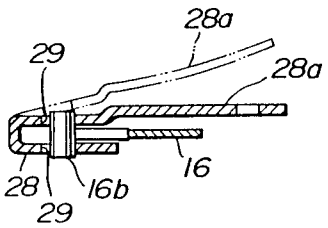
FIG. 6 is a sectional view taken along the line VI—VI of FIG. 5.

As will be seen from FIG. 6, the leading end portion of the rotating lever 28 is folded back to provide spaced side members (no numerals). The side members are respectively formed with aligned bores 29 to which the cylindrical end member 16*b* of the wire 16 is operatively mated. One of the side members, that is, the member 28*a*, is shaped longer than the other for facilitating an outward flexing thereof. With this structure, the cylindrical end member 16*b* can be easily disconnected from the rotating lever 28 by flexing the side member 28*a* outwardly as illustrated by a phantom line. This structure constitutes a so-called "fail safe means" in a case wherein due to malfunction of the automatic door latching system, various parts of the system are locked with the wire 16 kept tensioned.

It is to be noted that the bores 29 of the rotating lever 28 are of an arcuate slot which is concentric with the shaft 26. Thus, even if, after long use of the wire 16, the same is elongated to a certain extent, the elongation is absorbed by the arcuate shape of the bores 29. With this, the transmission of the movement from the rotating lever 28 to the afore-mentioned closing lever 14 is reliably carried out without forming a bent portion of the wire 16 under rest condition of the wire.

Designated by numeral 30 is a rest position detecting switch which detects the closing lever 14 of the above-mentioned door lock device 3 being at the rest position (as illustrated by a solid line in FIG. 2). That is, when the closing lever 14 is at the rest position, the sector gear 27 and the rotating lever 28 assume their rest positions illustrated by solid lines in FIG. 5 wherein the sector gear 27 presses a detecting pin (no numeral) of the switch 30 to actuate the switch 30.

When the motor 22 is energized to run in one direction, the sector gear 27 and the rotating lever 28 are pivoted together in a counterclockwise direction in FIG. 5 pulling the wire 16 leftward, while, when the motor 22 is energized to run in the other direction, the sector gear 27 and the rotating lever 28 are pivoted in a clockwise direction toward their rest positions pushing the wire 16 rightward.

When the sector gear 27 comes to the rest position, the rest position detecting switch 30 is actuated to stop operation of the motor 22.

Referring back to FIG. 1, a control unit 31 (which will be named a door-mounted control unit, hereinafter) is mounted in the door 1, which is connected through lead lines (no numerals) to the half-latch detecting switch 11, the full-latch detecting switch 20, the rest position detecting switch 30, the motor 22 and a safety switch 32. The safety switch 32 comprises a pressure sensitive sensor which is mounted on a front edge 1*b* of the door 1.

Another control unit 35 (which will be named a body-mounted control unit, hereinafter) is mounted on the vehicle body 2, which is connected through lead lines to a battery 33 and a door sensing switch 34 (which will be named as body-mounted power feeding switch, hereinafter).

The body-mounted door sensing switch 34 is arranged to cooperate with an operating lever 36. The operating lever 36 is pivotally connected to a lower side of the vehicle body 2. That is, when the door 1 is moved in a closing direction to a given position somewhat short of the half-latched position of the door 1, a part of the door 1 is brought into engagement with the operating lever 36 to pivot the same causing actuation of the body-mounted door sensing switch 34. Denoted by numeral 36*b* is a cam portion of the operating lever 36, which is engageable with a detecting pin (no numeral) of the door sensing switch 34.

Denoted by numeral 37 is an electric connector device which, under a given condition, connects the battery 33 mounted on the vehicle body 2 to the electric parts mounted in the door 1. The connector device 37 comprises a first connector part 38 mounted to a front end 1*b* of the door 1, and a second connector part 39 mounted to a pillar 2*a* of the vehicle body 2, these two parts being mated when the door 1 comes to the closed position.

Figure 7:
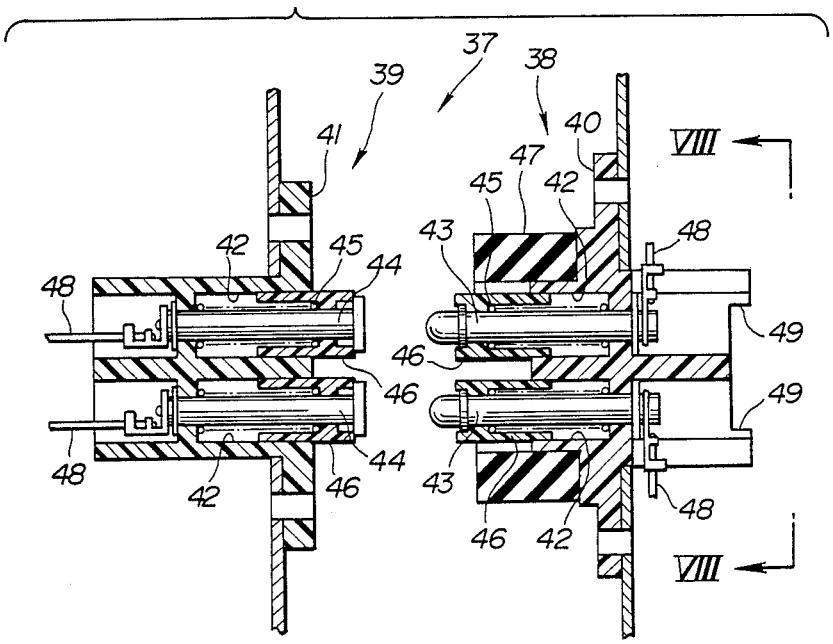
FIG. 7 is a sectional view of an electric connector device employed in the system of the first embodiment, the connector being indicated by the arrow VII in FIG. 1.
Figure 8:
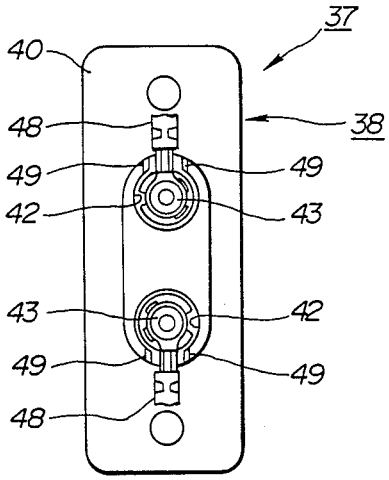
FIG. 8 is a view taken from the direction of the arrows VIII—VIII of FIG. 7.

As is clearly shown in FIGS. 7 and 8, each part 38 or 39 of the connector device 37 comprises a base structure 40 or 41 of nonconductive material having two parallel guide bores 42 formed therethrough. Each guide bore 42 has a contact pin 43 or 44 slidably disposed therein.

The contact pin 43 or 44 is biased in a direction to project from the base structure 40 or 41 by means of a compression spring 45. A stopper structure (no numeral) is provided for each contact pin 43 or 44 to prevent disconnection of the pin from the guide bore 42. The contact pins 43 have spherical head portions, while the contact pins 44 have flat head portions. Denoted by numeral 46 is a pin holder which is slidably disposed in each guide bore 42 for achieving a smooth movement of the pin 43 or 44. As shown, one end of each compressing spring 45 is seated on the pin holder 46. An elastic cover member 47 is disposed on the base structure 40 of the first part 38.

To the base portion of each contact pin 43 or 44, there is connected a lead line 48 which extends from the door-mounted control unit 31 or the body-mounted control unit 35, as shown. The base structure 40 of the first connector part 38 is formed at its rear end with a pair of projections 49 and 49 (see FIG. 8) for each contract pin 43. Due to provision of these projections 49 and 49, the rear end of each contact pin 43 to which the lead line 48 is connected is smoothly slided in the base structure 40.

The first and second connector parts 38 and 39 are arranged in such a manner that when the door 1 is moved in a closing direction to a given zone which ranges from the switch actuating position where the body-mounted door sensing switch 34 is actuated by the door 1 to the half-latched position of the door 1, the contact pins 43 of the first connector part 38 are brought into contact with their partner contact pins 44 of the second connector part 39 to achieve electric connection therebetween, and when the door 1 is further moved toward its fully-closed position, the contact pins 43 and 44 are projected into the associated guide bores 42 keeping the contact therebetween.

Accordingly, when the door 1 is moved in a closing direction beyond the switch actuating position, electric power is fed from the battery 33 to the electric parts mounted in the door 1.

Figure 9:
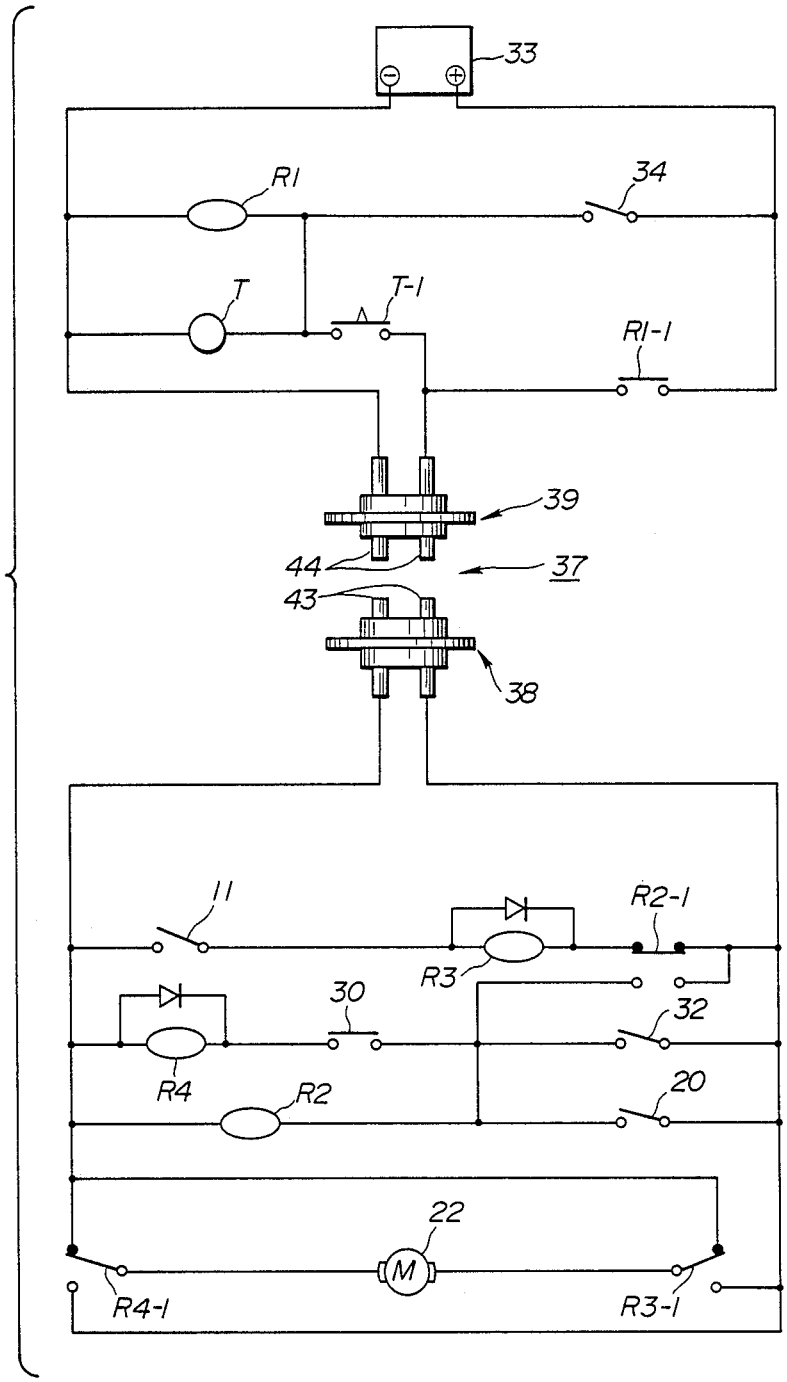
FIG. 9 is an electric circuit for controlling operation of the automatic door latching system of the first embodiment.

FIG. 9 shows a control circuit for controlling operation of the automatic door latching system of the first embodiment.

In the drawings, denoted by references R1, R2, R3 and R4 are relays, R1-1, R2-1, R3-1 and R4-1 are respective contacts of the relays, T is a timer of release time delayed type and T-1 is a contact of the timer.

In the following, operation of the automatic door latching system of the invention will be described with reference to FIGS. 1 and 9.

For ease of understanding, the description will be commenced with respect to a condition wherein the door 1 is fully opened as is illustrated by a solid line in FIG. 1.

When now the door 1 is pulled leftward in FIG. 1, the same is slided in a door closing direction. When the door 1 comes to the switch actuating position somewhat short of the half-latched position, the body-mounted door sensing switch 34 is turned ON for a short time due to turning of the operating lever 36. With this, the relay R1 and the timer T become energized closing their contacts R1-1 and T-1. Upon this, the timer T starts counting of time elapsed. Preferably, the timer T is set to change its state when counting about 10 seconds.

When the door 1 comes to the given zone which includes the switch actuating position, the first connector part 38 on the door 1 is mated with the second connector part 39 on the vehicle body 2 and thus at this time, electric supply from the battery 33 to the electric devices in the door 1 starts.

When then the door 1 comes to the half-latched position, the half-latch detecting switch 11 is turned ON. With this, the relay R3 is energized causing its contact R3-1 to switch to a normally open side, and thus the motor 22 is energized to run in one direction.

Due to the operation of the motor 22, the drive means 21 operates to pull the wire 16 causing the closing lever 14 to turn from the rest position toward the operative position moving the driven lever 7 of the latch plate 5. Thus, the latch plate 5 is forced to pivot from the half-latch position B to the full-latch position C. Under this condition, the door 1 is fully closed and fully latched.

When the latch plate 5 comes to the full-latch position C and the closing lever 14 comes to the operative position, the full-latch detecting switch 20 0 is turned ON. Upon this, the relay R2 is energized causing its contact R2-1 to switch to a normally open side, and thus the relay R3 is deenergized causing its contact R3-1 to switch to a normally closed side. Since, under this condition, the closing lever 14 and the sector gear 27 of the drive means 21 are separated from their rest positions keeping the rest position detecting switch 30 ON, the relay R4 is energized causing its contact R4-1 to switch to a normally open side.

With this, the current flow to the motor 22 is reversed and thus the motor 22 runs in a reversed direction.

Due to this operation of the motor 22, the closing lever 14 is turned from the operative position to the rest position. Because, under this condition, the latch plate 5 assumes the full-latch position C, the turning of the lever 14 does not induce a pivoting of the latch plate 5 from the full-latch position C to the half-latch position B. More specifically, under this condition, the turning of the lever 14 is carried out behind the driven lever 7 of the latch plate 5.

When the closing lever 14 and the sector gear 27 come to their rest positions, the rest position detecting switch 30 is turned OFF, and thus the relay R4 is deenergized causing its contact R4-1 to switch to a normally closed side. With this, the motor 22 is deenergized.

When thereafter the time (about 10 seconds) set by the timer T passes, the contact T-1 of the timer T is opened causing deenergization of the relay R1 and the timer T, and thus the contact R1-1 is opened. With this, the power supply from the battery 33 to the electric devices in the door 1 is ceased. It is thus to be noted that even when the door 1 is kept closed for a long time, undesired overdischarging of the battery 33 and overheating of the relays do not occur.

If, during the time for which the latch plate 5 is forced to turn from the half-latch position B toward the full-latch position C, a foreign thing, such as a cloth of a passenger, a baggage or the like, is accidently put between the door 1 and the vehicle body 2, the safety switch 32 is turned ON for preventing the latch plate 5 from taking the full-latch position C.

As is seen from the control circuit of FIG. 9, the safety switch 32 is arranged in parallel with the full-latch detecting switch 20. Thus, when the safety switch 32 is closed during the time for which the latch plate 5 is turned from the half-latch position B toward the full-latch position C, an operation takes place as if the full-latch detecting switch 20 has been closed and thus the closing lever 14 and the sector gear 27 are returned t their rest positions. Thus, the latch plate 5 fails to assume the full-latch position C.

In this case, the door 1 is opened for removing the foreign thing. Since, in such case, the door 1 fails to assume the fully closed position, the thing is protected from complete damage.

Figure 10:
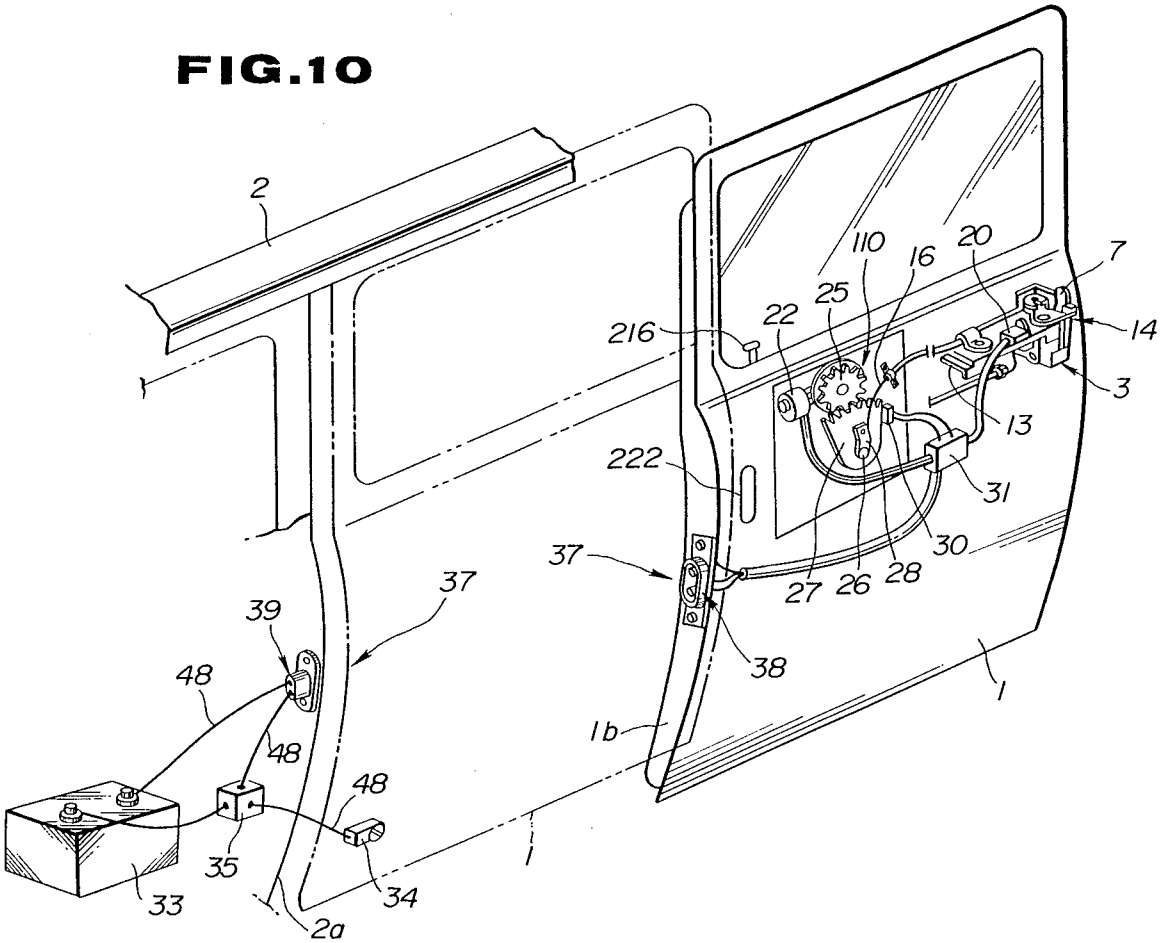
FIG. 10 is a view similar to FIG. 1, but showing a second embodiment of the present invention.
Figure 11:
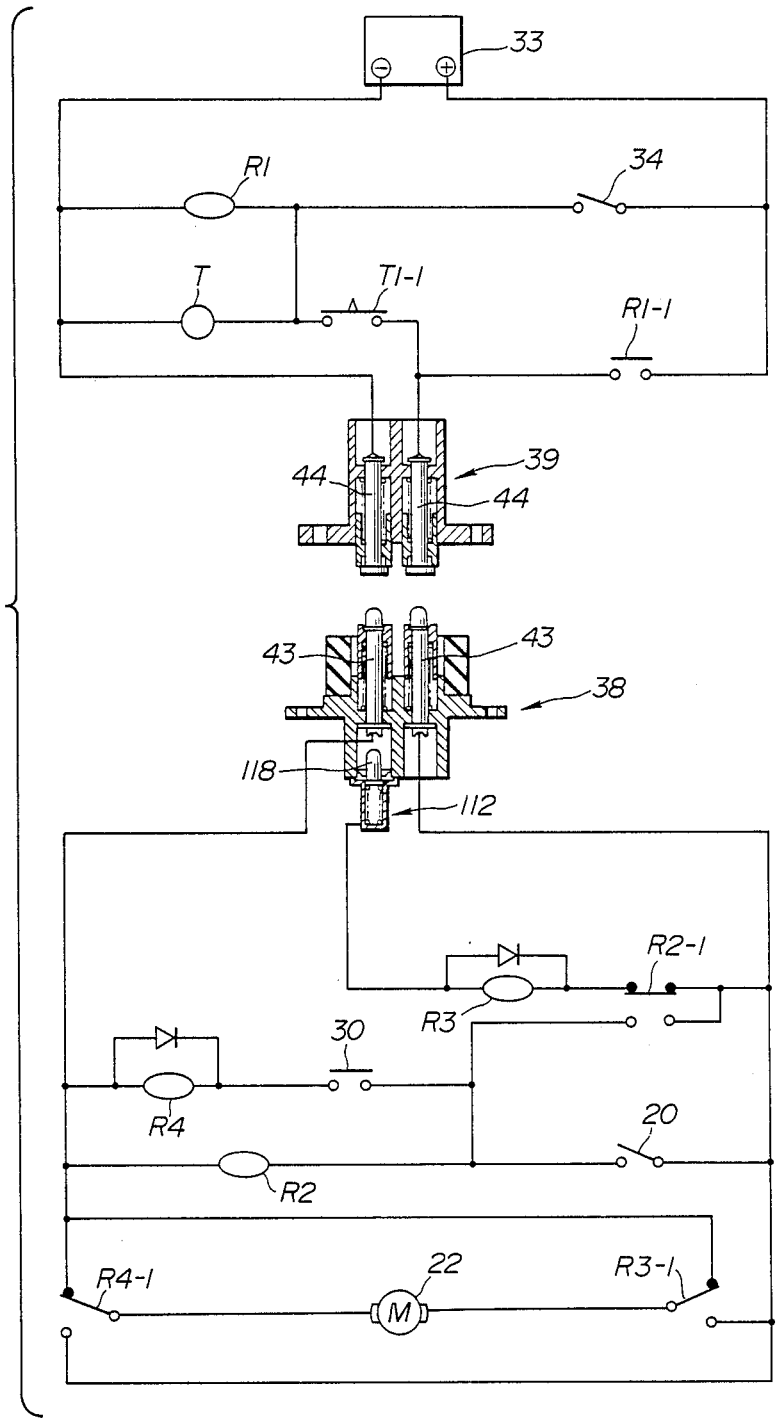
FIG. 11 is an electric circuit for controlling operation of the system of the second embodiment.
Figure 12:
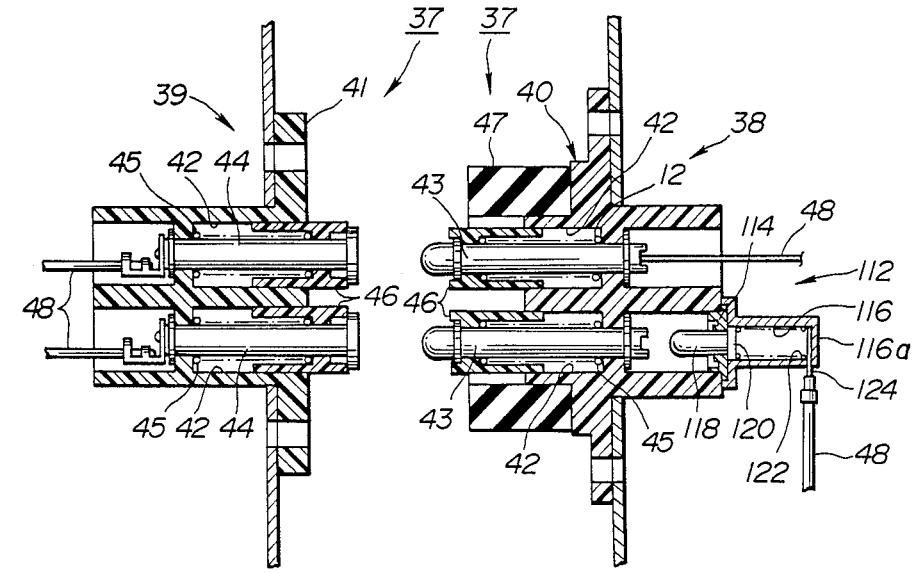
FIG. 12 is a sectional view of an electric connector device employed in the second embodiment.

Referring to FIGS. 10 to 12, there is shown a second embodiment of the present invention.

In the drawings, the parts substantially the same as those in the above-mentioned first embodiment are denoted by the same numerals. Thus, detailed description of such same parts will be omitted from the following description.

In FIG. 10, denoted by numeral 1 is a slide door which is slidably supported by a vehicle body 2 in such a manner as has been described in the part of the first embodiment. A door lock device 3 is mounted to a rear end portion of the door 1. A drive means 110 for enforcedly turning a latch plate of the door lock device 3 to its full-latch position is mounted to the door 1. The door has further a door-mounted control unit 31 mounted therein.

Denoted by numeral 37 is an electric connector device which comprises a first connector part 38 mounted to a front end 1*b* of the door 1 and a second connector part 39 mounted to a pillar 2*a* of the vehicle body 2.

The electric connector 38 will be described in detail with reference to FIG. 12.

Similar to the connector 38 in the first embodiment, each part 38 or 39 comprises a base structure 40 or 41 having two parallel guide bores 42 formed therethrough. Each guide bore 42 has a contact pin 43 or 44 slidably disposed therein. The contact pin 43 or 44 is biased in a direction to project from the base structure 40 or 41 by means of a compression spring 45. Preferably, the spring 45 in the first connector part 38 and that in the second connector part 39 have the same spring constant. A stopper structure (no numeral) is provided for each contact pin 43 or 44 to prevent disconnection of the pin from the guide bore 42. A pin holder 46 is slidably disposed in each guide bore 42, which moves together with the associated contact pin 43 or 44. An elastic cover member 47 is disposed on the base structure 40 of the first connector part 38.

To one of the contact pins 43 of the first connector part 38, there is connected a lead line 48 which extends from the door-mounted control unit 31. A so-called half-latch detecting switch 112 is incorporated with the other contact pin 43 in such a manner as will be described hereinafter. To the contact pins 44 of the second connector part 39, there are connected lead lines 48 one of which extends from a body-mounted control unit 35 (see FIG. 10) and the other of which extends from the battery 33.

The half-latch detecting switch 112 comprises an apertured guide member 114 which is connected to a back portion of the base structure 40 of the first connector part 38 in such a manner that the aperture thereof faces the rear end of the contract pin 43. A cylindrical case 116 of nonconductive material is coaxially connected at its flanged mouth portion to the guide member 114. A shorter contact pin 118 is slidably held by the apertured guide member 114. The contact pin 118 has an enlarged base portion 120 slidably received in the cylindrical case 116. A spring 122 is compressed between the contact pin 118 and a bottom of the bore 116*a* of the cylindrical case 116 to bias the contact pin 118 toward the associated contact pin 43. A terminal member 124 has a portion disposed between the bottom of the bore 116*a* and the spring 122. Thus, the shorter contact pin 118 and the terminal member 124 are electrically connected through the spring 122. The terminal member 124 is connected through a lead line 48 to the door-mounted control unit 31.

Referring back to FIG. 10, denoted by numeral 34 is a body-mounted door sensing switch which is located near the pillar 2*a*. When the door 1 is moved in a closing direction to a given position somewhat short of the half-latched position of the door 1, the door sensing switch 34 is turned ON for a short time. The door sensing switch 34 is connected through a lead line (no numeral) to the body-mounted control unit 35. As will be clarified hereinafter, the electric power supply to the electric parts mounted in the door 1 is controlled by the door sensing switch 34 and the body-mounted control unit 35.

The drive means 110 comprises, similar to the drive means 21 of the first embodiment, a reversible electric motor 22. Driven by the motor 22 is a speed reduction device (not shown) whose output has a pinion 25 disposed thereon. A sector gear 27 is pivotally connected through a shaft 26. The sector gear 27 has at its rim a plurality of teeth engaged with the pinion 25. A rotating lever 28 is pivotally connected to the shaft 26 to rotate together with the sector gear 27. The rotating lever 28 has a leading end to which a wire 16 extending from a closing lever 14 is connected.

A full-latch detecting switch 20 is mounted to a supporting plate 13, which detects the latch plate 5 of the door lock device 3 being at the full-latch position. Designated by numeral 30 is a rest position detecting switch which detects the closing lever 14 being at the rest position.

FIG. 11 shows a control circuit for controlling operation of the automatic door latching system of the second embodiment.

In the following, operation of the second embodiment will described with reference to FIGS. 10 and 11.

For ease of understanding, the description will be commenced with respect to a condition where the door 1 is fully opened as illustrated by a solid line in FIG. 1.

When now the door 1 is pushed leftward in FIG. 10, the same is slided in a door closing direction. When the door 1 comes to the switch actuating position somewhat short of the half-latched position, the body-mounted door sensing switch 34 is turned ON for a short time. With this, the relay R1 and and the timer T become energized closing their contacts R1-1 and T-1. Upon this, the timer T starts counting of time elapsed.

When the door 1 comes to the given zone which includes the switch actuating position, the first connector part 38 on the door 1 is mated with the second connector part 39 on the vehicle body 2 and thus, at this time, electric supply from the battery 33 to the electric devices in the door 1 starts.

When then the door 1 comes to the half-latched position, the half-latch detecting switch 112 becomes ON due to contact between the contact pins 43 and 118. With this, the relay R3 is energized due to closing operation of a normally closed contact R2-1 of the relay R2, so that a contact R3-1 of the relay R3 switches to a normally open side, and thus the motor 22 is energized to run in one direction.

Due to operation of the motor 22, the drive means 110 operates to pull the wire 16 causing the closing lever 14 to turn from the rest position toward the operative position moving the driven lever 7 of the latch plate 5 of the door lock device 3. Thus, the latch plate 5 is forced to pivot from the half-latch position to the full-latch position. Thus, the door 1 is fully closed and fully latched.

When the latch plate 5 comes to the full-latch position and the closing lever 14 comes to the operative position, the full-latch detecting switch 20 is turned ON. Upon this, the relay R2 is energized causing its contact R2-1 to switch to a normally open side and at the same time, the contact R3-1 of the relay R3 switches to a normally closed side. Since, under this condition, the closing lever 14 and the sector gear 27 of the drive means 21 are separated from their rest positions keeping the rest position detecting switch 30 ON, the relay R4 is energized causing its contact R4-1 to switch to a normally open side.

With this, the current flow to the motor 22 is reversed and thus the motor 22 runs in a reversed direction.

Due to the operation of the motor 22, the closing lever 14 is turned from the operative position to the rest position. Because, under this condition, the latch plate 5 assumes the full-latch position, the returning movement of the lever 14 does not induce a pivoting of the latch plate from the full-latch position to the half-latch position.

When the closing lever 14 and the sector gear 27 come to their rest positions, the rest position detecting switch 30 is turned OFF, and thus the relay R4 is deenergized causing its contact R4-1 to switch to a normally closed side. With this, the motor 22 is deenergized stopping its running.

When thereafter the time set by the timer T passes, the relay R1 becomes deenergized. Thus, the power supply from the battery 33 to the electric devices in the door 1 is ceased. It is thus to be noted that even when the door 1 is kept closed for a long time, undesired overdischarging of the battery 33 and overheating of the relays do not occur.

As will be understood from the above-description, when the door 1 is kept opened, the electric circuit between the battery 31 and the second connector part 39 is opened. Thus, even when a conductive foreign thing is accidently contacted to the contact pins 44 of the part 39, there is no fear of electric spark.

Figure 13:
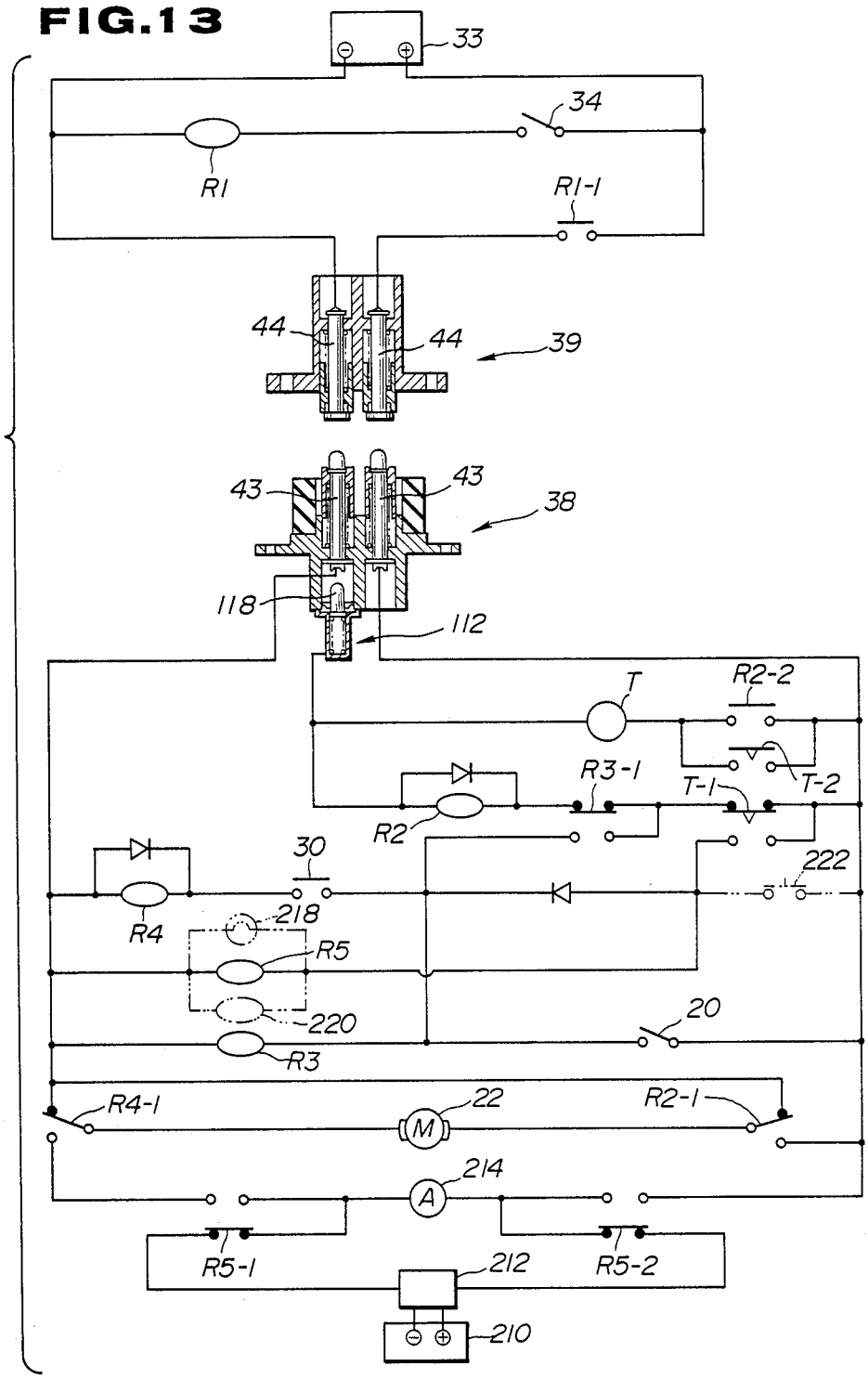
FIG. 13 is a modification of the electric circuit of the second embodiment.

Referring to FIG. 13, there is shown a modified electric circuit employable for controlling the system of the second embodiment.

In this modification, a timer T is contained in the door-mounted control unit, which is used for enforcedly returning the closing lever 14 to its rest position when the full-latch condition of the latch lever 5 is not provided within a given time elapsed from the time when a half-latched condition of the door is detected.

In the circuit shown in FIG. 13, denoted by references R1, R2, R3, R4 and R5 are relays, R1-1, R2-1, R2-2, R3-1, R4-1, R5-1 and R5-2 are contacts of the relays, T is a timer of release time delayed type, T-1 and T-2 are contacts of the timer T. Denoted by numeral 214 is an electric actuator which is arranged to move a locking knob 216 (see FIG. 10) in locking and unlocking directions selectively when energized. Denoted by 212 is a control device for controlling the actuator 214, which is connected to a battery 210.

In the following, operation of the system by this modification will be described with reference to FIGS. 10 and 13.

For ease of understanding, the description will be commenced with respect to a condition wherein the door 1 is fully opened as illustrated by a solid line in FIG. 10.

When now the door 1 is pulled leftward, the same is slided in a door closing direction. When the door 1 comes to the switch actuating position somewhat short of the half-latched position, the door sensing switch 34 is turned ON for a short time. With this, the relay R1 in the body-mounted control unit 35 is energized closing its contact R1-1, and thus the second connector part 39 on the vehicle body 2 assumes its stand-by position.

When the door 1 comes to the given zone which includes the switch actuating position, the first connector part 38 on the door 1 is mated with the second connector part 39 on the vehicle body and thus, from this time, electric supply from the battery 33 to the electric parts in the door 1 starts.

When then the door 1 comes to the half-latched position, the half-latch detecting switch 112 becomes ON due to contact of one contact pin 43 to the shorter contact pin 118. With this, the relay R2 is energized due to a normally closed operation of the contact R3-1 of the relay R3 and the timer contact T-1, and thus the contact R2-2 of the relay R2 is closed energizing the timer T.

Upon this, the timer T starts the counting of time elapsed. Preferably, the timer T is set to measure five seconds.

Upon energization of the relay R2, the contact R2-1 of this relay R2 switches to a normally open side energizing the motor 22 to run in one direction.

Due to operation of the motor 22, the drive means 110 operates to pull the wire 16 causing the closing lever 14 to turn from the rest position toward the operative position moving the driven lever 7 of the latch plate 5 of the door lock device 3. Thus, the latch plate 5 is forced to pivot from the half-latch position to the full-latch position. Thus, the door 1 is fully closed and fully latched.

When the latch plate 5 comes to the full-latch position and the closing lever 14 comes to the operative position, the full-latch detecting switch 20 is turned ON. With this, the relay R3 is energized causing the contact R3-1 to switch to a normally open side and the normally closed side to open, so that the contact R2-1 of the relay R2 is returned to a normally closed side deenergizing the motor 22. Since, under this condition, the closing lever 14 and the sector gear 27 of the drive means 21 are separated from their rest postions keeping the rest position detecting switch 30 ON, the relay R4 is energized causing its contact R4-1 to switch to the open side.

With this, the current flow to the motor 22 is reversed and the motor 22 runs in a revesed direction.

Due to operation of the motor 22, the closing lever 14 is turned from the operative position to the rest position. Because, under this condition, the latch plate 5 assumes the full-latch position, the returning movement of the closing lever 14 does not induce a pivoting of the latch 5 to the half-latch position.

When the closing lever 14 and the sector gear 27 come to their rest position, the rest postion detecting switch 30 is turned OFF, and thus the relay R4 is deenergized causing its contact R4-1 to switch to a normally closed side. With this, the motor 22 is deenergized stopping its running.

The timer T stops its time counting operation when the relay R2 is deenergized to open the contact R2-2.

When the door 1 is strongly moved by an operator (or passenger) to the fully-latched position, an operation similar to the above-mentioned operation is carried out. However, since the energization of the time T is ceased when the contact R3-1 of the relay R3 switches, there is no fear of operation of the motor 22 and the actuator 214 thereafter.

If, during the time for which the latch plate 5 is forced to turn from the half-latch position toward the full-latch position, a foreign thing, such as a cloth of a passenger, a baggage of the like, is accidently put between the door 1 and the vehicle body 2, the following operation takes place.

That is, if, for this reason, the latch plate 5 in the half-latch position fails to assume the full-latch position within a given time (for example, five seconds), the timer T operates to switch the contact T-1 to a normally open side and the other contact T-2 to a closed side.

Although, in this time, the contact R2-2 of the relay R2 becomes open due to deenergization of the same, energization of the timer T is continued because the contact T-2 of the timer T is closed.

When the relay R2 is deenergized, the contact R2-1 of the relay R2 is returned to a normally closed side and thus the motor 22 is stopped.

When the motor 22 is stopped, the relay R4 operates causing the contact R4-1 to switch to the other side, and thus, the motor 22 is energized to run in a reversed direction.

As a result, the sector gear 27 is returned to its rest position and at the same time, the door 1 is forced to return to the half-latched position instantly stopping the movement toward the full-latched position. Thus, thereafter, the door 1 can be opened easily by manual labor.

If, at same time, the locking knob 216 assumes the locking position, the relay R5 is energized at just the time when the counting operation of the timer T starts, causing the contacts R5-1 and R5-2 to switch to their normally open sides. With this, the actuator 214 operates to cancel the locking condition of the locking knob 216. Thus, the door 1 can be opened without manipulating a key or the locking knob 216.

If, a lamp 218 and/or a buzzer 220 is arranged in parallel with the relay R5, a visual or acoustic alarm is produced when the timer T starts its operation.

Figure 14:
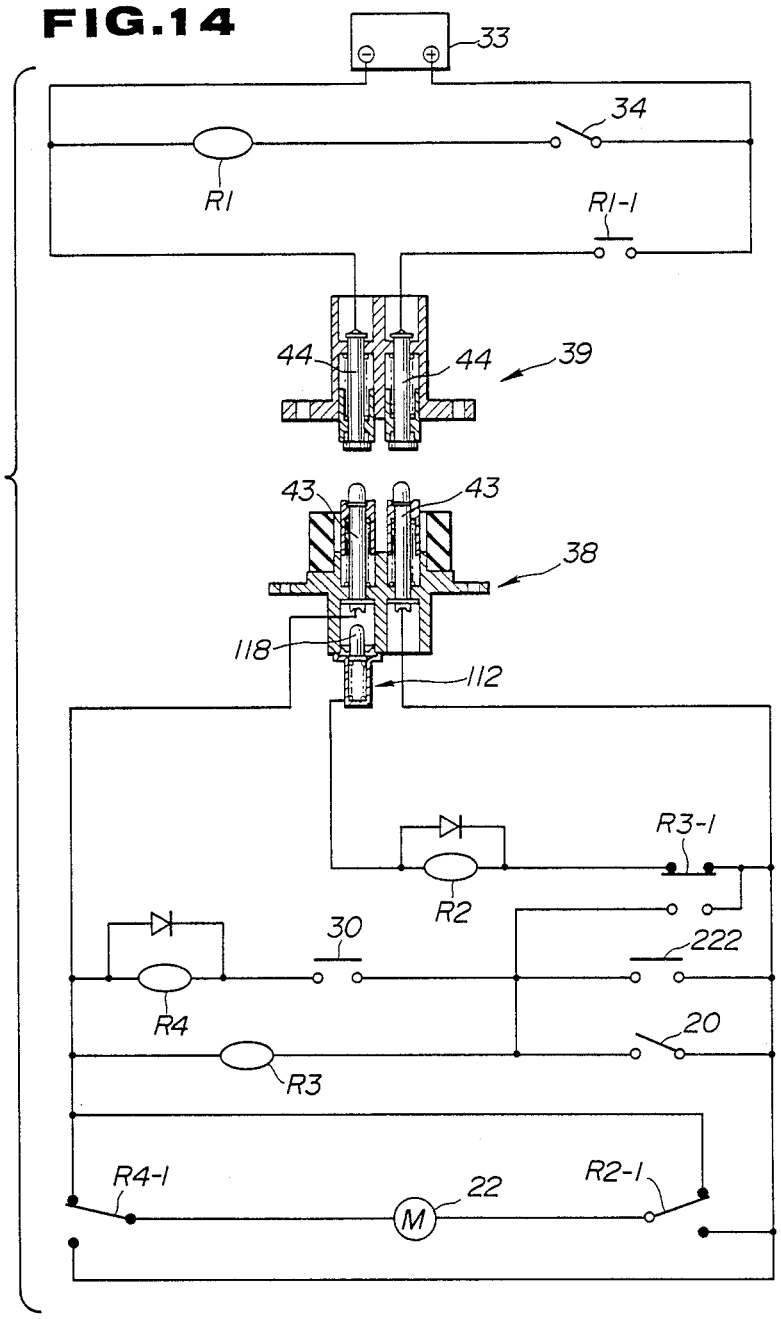
Fig 14 is another modification of the electric circuit of the second embodiment.

Referring to FIG. 14, there is shown another modification of the control circuit of the second embodiment.

In this modification, in place of the the above-mentioned timer T, a switch 222 is employed which is actuated by an outside handle 224 (see FIG. 10) and/or an inside handle (not shown) of the door 1. The switch 222 is connected in series with the relays R3 and R4, but in parallel with the full-latch detecting switch 20.

When the slide door 1 comes to the half-latch position and thus the half-latch position sensor 118 operates, the door 1 is automatically moved to the fully latched position by taking such steps as described hereinabove.

If, during the time for which the latch plate 5 is forced to turn from the half-latch position toward the full-latch position, a foreign thing, such as a cloth of a passenger, a baggage or the like is accidently put between the door 1 and the vehicle body 2 thereby making the fully door closing inavailable, the outside handle 216 or the inside handle is manipulated. With this, the switch 222 is turned ON producing a condition which is the same as the condition produced when the full-latch detecting switch 20 is turned ON.

With this, the relay R3 is energized causing the contact R3-1 to switch to a normally open side and the normally closed side to open, so that the contact R2-1 of the relay R2 is returned to a normally closed side. Thus, the motor 22 is stopped and thus the door latching movement is stopped Upon this, the relay R4 starts to operate causing the motor 22 to run in a reversed direction. Thus, the sector gear 27 is returned to its rest position and the door 1 is returned to the half-latched position.

If desired, similar to the above-mentioned first modification, the locking knob cancelling system may be employed in this second modification. That is, the system is so arranged that when the switch 222 is actuated, the actuator 214 (see FIG. 13) is energized to cancel the locking condition of the locking knob 216.

Furthermore, if desired, as is seen from the circuit of FIG. 13, such switch 222 may be arranged in parallel with the timer T. The switch 222 is manipulated in the case where the timer T fails to operate.

What is claimed is:

1. In a motor vehicle having a vehicle body and a door, an automatic door latching system comprising:

a door lock device carried by said door to move therewith, said lock device having a latch plate which is pivotal to assume a full-open position wherein the latch plate releases a striker secured to the vehicle body, a half-latch position wherein the latch plate is halfly engaged with said striker and a full-latch position wherein the latch plate is fully engaged with said striker;

a driven lever integrally connected to said latch plate to move therewith;

a closing lever which is pivotal to assume a rest position and an operative position, said closing lever pushing said driven lever in a direction to cause said latch plate to pivot from said half-latch position to said full-latch position when pivoting from said rest position toward said operative position;

an electric drive means mounted to said door to drive said closing lever when energized;

a half-latch detecting means for detecting the half-latch condition of said latch plate;

a full-latch detecting means for detecting the full-latch condition of said latch plate;

a rest position detecting means for detecting the closing lever being at said rest position;

a first control unit mounted to said door for controlling operation of said drive means in accordance with information signals issued by said half-latch, full-latch and rest position detecting means; and a control means including a second control unit mounted on said vehicle body, for selectively feeding electric power to said electric drive means, said half-latch detecting means, said full-latch detecting means, said rest position detecting means and said first control unit when said door is moved in a door closing direction to a given position near the half-latched position of the door.

2. An automatic door latching system as claimed in claim 1, in which said first control unit energizes said electric drive means to pivot said closing lever from said rest position to said operative position when receiving from said half-latch detecting means a signal representative of the latch plate being in the half-latch position.

3. An automatic door latching system as claimed in claim 2, in which said first control unit energizes said electric drive means to pivot said closing lever from said operative position to said rest position when receiving from said full-latch detecting means a signal representative of the latch plate being in the full-latch position.

4. An automatic door latching system as claimed in claim 3, in which said first control unit deenergizes said electric drive means when receiving from said rest position detecting means a signal representative of the closing lever being in the rest position.

5. An automatic door latching system as claimed in claim 1, in which said control means comprises a timer which is arranged to effect the electric power feeding only within a given time.

6. An automatic door latching system as claimed in claim 5, in which said control means further comprises a door sensing switch which is turned ON for a short time when said door is moved in a door closing direction to a position somewhat short of the half-latched position of the door.

7. An automatic door latching system as claimed in claim 6, wherein said second control unit starts the time counting operation of said timer when said door sensing switch is turned ON.

8. An automatic door latching system as claimed in claim 7, in which said electric power feeding means further comprises an electric connector device which comprises:

a first connector part mounted to said door to move therewith; and a second connector part mounted to said vehicle body, wherein said first connector connector part is mated with said second connector part to achieve an electric connection therebetween when said door comes to said half-latched position thereof.

9. An automatic door latching system as claimed in claim 8, in which each of said first and second connector parts comprises:

a base structure of nonconductive material having two parallel bores formed therethrough;

a conctact pin slidably received in each of said bores; and biasing means for biasing each contact pin to project outward but partially from the associated bore.

10. An automatic door latching system as claimed in claim 9, in which said first and second connector parts are so arranged that when said door comes to said half-latched position, the projected parts of the contact pins of said first connector part are brought into resilient contact with the projected parts of the contact pins of said second connector part.

11. An automatic door latching system as claimed in claim 10, in which said first connector part is equipped with said half-latch detecting means, said half-latch detecting means including:

a cylindrical case secured to said base structure in such a manner that a mouth thereof faces a rear end of one of said contact pins of the first connector part;

a shorter contact pin slidably disposed in said cylindrical case; and biasing means for biasing said shorter contact pin to project toward said rear end of one of the contact pins of the first connector part.

12. An automatic door latching system as claimed in claim 4, in which said first control unit contains a timer which is used for enforcedly returning said closing lever to the rest position when the full-latch condition of said latch plate is not provided within a given time elapsed from the time when the half-latch condition of the door is detected.

13. An automatic door latching system as claimed in claim 12, further comprising:

an electric actuator arranged to move a locking knob in locking and unlocking directions selectively when energized; and a third control unit for controlling operation of said electric actuator.

14. An automatic door latching system as claimed in claim 13, further comprising an alarm device which issues an alarm when said timer starts its operation.

15. An automatic door latching system as claimed in claim 14, in which said alarm system includes one of a lamp and a buzzer.

16. An automatic door latching system as claimed in claim 4, in which said first control unit comprises a switch which is actuated in response to manual operation of a door outside handle or a door inside handle, said switch being arranged in parallel with said full-lateh detecting means.

17. An automatic door latching system as claimed in claim 4, in which said electric drive means comprises:

a reversible electric motor;

a speed reduction device connected to said motor;

a pinion disposed on an output shaft of said speed reduction device;

a sector gear operatively engaged with said pinion; and a wire extending between said sector gear and said closing lever.

18. An automatic door latching system as claimed in claim 17, in which said half-latch detecting means comprises a switch which is mounted to said door lock device and actuated by an open lever which moves together with said latch plate.

19. An automatic door latching system as claimed in claim 18, in which said full-latch detecting means comprises a switch which is mounted to be actuated by a part of said closing lever.

20. An automatic door latching system as claimed in claim 19, in which said rest position detecting means comprises a switch which is arranged to be actuated by a part of said electric drive means.

* * * * *